US009050810B2

(12) United States Patent
Kaneko et al.

(10) Patent No.: US 9,050,810 B2
(45) Date of Patent: Jun. 9, 2015

(54) IMAGE FORMING APPARATUS CONFIGURED WITH RECORDING HEAD CAP HAVING PLURAL RELEASE VALVES

(71) Applicants: Tetsuya Kaneko, Kanagawa (JP); Yuta Moriwaki, Kanagawa (JP)

(72) Inventors: Tetsuya Kaneko, Kanagawa (JP); Yuta Moriwaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 109 days.

(21) Appl. No.: 13/923,515

(22) Filed: Jun. 21, 2013

(65) Prior Publication Data

US 2014/0009531 A1 Jan. 9, 2014

(30) Foreign Application Priority Data

Jul. 9, 2012 (JP) ..... 2012-153262

(51) Int. Cl.
*B41J 2/165* (2006.01)
*B41J 2/175* (2006.01)

(52) U.S. Cl.
CPC ..... *B41J 2/16523* (2013.01); *B41J 2/16505* (2013.01); *B41J 2/16508* (2013.01); *B41J 2/16532* (2013.01); *B41J 2/17596* (2013.01); *B41J 2002/16573* (2013.01)

(58) Field of Classification Search
CPC ..... B41J 2/16523; B41J 2/16505; B41J 2/17596; B41J 2002/16573; B41J 2/16532; B41J 2/16508
USPC ..... 347/30, 29, 85, 32; 271/3.14
See application file for complete search history.

(56) References Cited

U.S. PATENT DOCUMENTS

| | | | | |
|---|---|---|---|---|
| 6,017,109 | A * | 1/2000 | Saijo | 347/30 |
| 6,203,136 | B1 * | 3/2001 | Takahashi et al. | 347/32 |
| 6,824,129 | B2 * | 11/2004 | Sides, II | 271/3.14 |
| 7,465,044 | B2 * | 12/2008 | Fukazawa | 347/85 |
| 8,382,236 | B2 * | 2/2013 | Shimazaki | 347/29 |
| 8,608,279 | B2 * | 12/2013 | Nakazawa | 347/32 |
| 2003/0107632 | A1 | 6/2003 | Arita et al. | |
| 2005/0190251 | A1 | 9/2005 | Katsuyama | |
| 2006/0176333 | A1 * | 8/2006 | Momose et al. | 347/30 |
| 2007/0109362 | A1 | 5/2007 | Hori et al. | |
| 2007/0165065 | A1 | 7/2007 | Tamai et al. | |
| 2008/0136849 | A1 | 6/2008 | Kaneko | |

(Continued)

FOREIGN PATENT DOCUMENTS

| | | |
|---|---|---|
| JP | 10-323998 | 12/1998 |
| JP | 2000-211164 | 8/2000 |

(Continued)

*Primary Examiner* — Julian Huffman
*Assistant Examiner* — Carlos A Martinez
(74) *Attorney, Agent, or Firm* — Cooper & Dunham LLP

(57) ABSTRACT

An image forming apparatus includes an apparatus body, a recording head, a cap member, and release valves. The head has a nozzle face with nozzles to eject liquid droplets. The head is placed in the apparatus body so as to eject the droplets obliquely downward in any of the vertical or horizontal arrangement of the apparatus body. The cap member caps the nozzle face and has openings at opposed ends in a longitudinal direction of the cap member to communicate an inside of the cap member with an outside of the cap member. The valves open and close the openings relative to an atmosphere. One of the valves placed higher than another one of the valves in accordance with the vertical or horizontal arrangement is configured to open the inside of the cap member to the atmosphere through one of the openings placed higher than another one of the openings.

5 Claims, 21 Drawing Sheets

(56) References Cited

U.S. PATENT DOCUMENTS

| | | | | |
|---|---|---|---|---|
| 2008/0238982 | A1 | 10/2008 | Kaneko et al. | |
| 2010/0289850 | A1* | 11/2010 | Watanabe | 347/30 |
| 2011/0242204 | A1* | 10/2011 | Shinoda | 347/29 |
| 2011/0304676 | A1* | 12/2011 | Hirabayashi | 347/85 |

FOREIGN PATENT DOCUMENTS

| | | |
|---|---|---|
| JP | 2005-224960 | 8/2005 |
| JP | 2006-142625 | 6/2006 |
| JP | 2006-159528 | 6/2006 |
| JP | 2012-035502 | 2/2012 |

* cited by examiner

IMAGE FORMING APPARATUS CONFIGURED WITH RECORDING HEAD CAP HAVING PLURAL RELEASE VALVES

CROSS-REFERENCE TO RELATED APPLICATIONS

This patent application is based on and claims priority pursuant to 35 U.S.C. §119 to Japanese Patent Application No. 2012-153262, filed on Jul. 9, 2012, in the Japan Patent Office, the entire disclosure of which is hereby incorporated by reference herein.

BACKGROUND

1. Technical Field

This disclosure relates to an image forming apparatus and more specifically to an image forming apparatus including a recording head to eject liquid droplets.

2. Description of the Related Art

Image forming apparatuses are used as printers, facsimile machines, copiers, plotters, or multifunction devices having two or more of the foregoing capabilities. As one type of image forming apparatuses employing a liquid-ejection recording method, for example, inkjet recording apparatuses are known that use a recording head (liquid ejection head or liquid-droplet ejection head) for ejecting droplets of liquid (e.g., ink).

Such an image forming apparatus employing a liquid-ejection recording method may have a maintenance device (maintenance and recovery device) to maintain the stability of ejection performance of nozzles of a recording head. The maintenance device includes a cap and a wiping member. The cap caps a nozzle face of the recording head to prevent drying of ink in nozzles and intrusion of dust into nozzles. The wiping member (also referred to as, e.g., a wiper blade, wiping blade, or blade) wipes the nozzle face of the recording head for cleaning. For example, after discharging ink having an increased viscosity due to drying into the cap, such an image forming apparatus performs a recovery operation to wipe the nozzle face with the wiping member and form menisci in nozzles.

For such an image forming apparatus, for example, a droplet ejection face (nozzle face) of a recording head for ejecting liquid droplets may be oriented obliquely downward so that the image forming apparatus be usable regardless of whether an apparatus body is vertically or horizontally arranged (e.g., JP-2006-142625-A).

Such an image forming apparatus is designed to prevent liquid (waste liquid) discharged from the recording head into the cap from leaking from the cap in any of the vertical or horizontal arrangement.

For example, for an image forming apparatus described in JP-2006-142625-A, the cap has a bottom face being upright or tilted relative to the vertical direction in any of the vertical or horizontal arrangement. In other words, the image forming apparatus has a cap bottom face forming the bottom face of the cap in one of the vertical or horizontal arrangement, a cap side wall forming a recessed portion between the cap side wall and the cap bottom face, and a waste-liquid receptacle to store waste liquid in the recessed portion and having a blocking member disposed upright from the cap side wall toward the recessed portion to prevent waste liquid on the bottom face of the cap from leaking to the outside of the cap via the side wall of the cap.

However, for the image forming apparatus, in a configuration in which the cap is tilted relative to the vertical direction, the amount of waste liquid discharged into the cap is controlled to be smaller than in a configuration in which an opening of the cap is horizontally arranged, to prevent waste liquid from flowing over the blocking member. For such a configuration, the inventors have recognized that, if the discharged amount of waste liquid is too large, the waste liquid may flow over the blocking member to the outside.

In addition, in the vertical arrangement of the apparatus body, waste liquid may be blocked by the blocking member at a position lower than a suction port of the cap or retained by capillary action of the recessed portion, thus preventing waste liquid from being discharged from the cap.

However, the inventors have recognized that, if waste liquid remains in the cap, solid components in ink may accumulate near the blocking member or in the recessed portion, thus causing leakage of ink over time. In addition, such ink remaining in the cap may absorb moisture from nozzles to compensate moisture loss due to drying, thus causing a reduced reliability in ejection performance after capping operation.

BRIEF SUMMARY

In at least one exemplary embodiments of this disclosure, there is provided an image forming apparatus including an apparatus body, a recording head, a cap member, and release valves. The apparatus body is usable in any of a vertical or horizontal arrangement. The recording head has a nozzle face with nozzles to eject liquid droplets. The recording head is placed in the apparatus body so as to eject the liquid droplets obliquely downward in any of the vertical or horizontal arrangement of the apparatus body. The cap member caps the nozzle face of the recording head and has openings at opposed ends in a longitudinal direction of the cap member to communicate an inside of the cap member with an outside of the cap member. The release valves open and close the openings relative to an ambient atmosphere. One of the release valves placed higher than another one of the release valves in accordance with the vertical or horizontal arrangement of the apparatus body is configured to open the inside of the cap member to the ambient atmosphere through one of the openings placed higher than another one of the openings.

In at least one exemplary embodiments of this disclosure, there is provided an image forming apparatus including an apparatus body, a recording head, a cap member, release valves, and a suction device. The apparatus body is usable in any of a vertical or horizontal arrangement. The recording head has a nozzle face with nozzles to eject liquid droplets. The recording head is placed in the apparatus body so as to eject the liquid droplets obliquely downward in any of the vertical or horizontal arrangement of the apparatus body. The cap member caps the nozzle face of the recording head and has openings at opposed ends in a longitudinal direction of the cap member to communicate an inside of the cap member with an outside of the cap member. The release valves open and close the openings relative to an ambient atmosphere. The suction device is connected to the cap member. The cap member has a cap body to receive waste liquid discharged from the recording head. The cap body has a triangular shape with a first edge, a second edge, and a base edge in a cross section. The cap body has the base edge at a first side at which the cap member is configured to oppose the recording head and an apex formed by the first edge and the second edge at a second side opposite to the first side. The cap body has, at the apex, a suction port connected to the suction device. A first angle formed by the nozzle face of the recording head and a plane on which the apparatus body is placed is smaller than a second angle formed by the base edge of the cap body and one of the first edge or the second edge placed lower than the other of the first edge or the second edge.

In at least one exemplary embodiments of this disclosure, there is provided an image forming apparatus including an apparatus body, a recording head, a cap member, and a suction device. The apparatus body is usable in any of a vertical or horizontal arrangement. The recording head has a nozzle face with nozzles to eject liquid droplets. The recording head is placed in the apparatus body so as to eject the liquid droplets obliquely downward in any of the vertical or horizontal arrangement of the apparatus body. The cap member caps the nozzle face of the recording head and having openings at opposed ends in a longitudinal direction of the cap member to communicate an inside of the cap member with an outside of the cap member. The suction device is connected to the cap member via one of the openings placed lower than another one of the openings in accordance with the vertical or horizontal arrangement of the apparatus body. The inside of the cap member is configured to be opened to an ambient atmosphere through the another one of the openings placed higher than the one of the openings.

In at least one exemplary embodiments of this disclosure, there is provided an image forming apparatus including an apparatus body, a recording head, and a cap member. The apparatus body is usable in any of a vertical or horizontal arrangement. The recording head has a nozzle face with nozzles to eject liquid droplets. The recording head is placed in the apparatus body so as to eject the liquid droplets obliquely downward in any of the vertical or horizontal arrangement of the apparatus body. The recording head has suction ports at opposed end portions in a longitudinal direction of the nozzle face. The cap member caps the nozzle face of the recording head. The cap member has a release port to communicate an inside of the cap member with an outside of the cap member, a separation film at the release port to separate gas from liquid, and a release valve to open and close the release port.

In at least one exemplary embodiments of this disclosure, there is provided an image forming apparatus including an apparatus body, a recording head, and a cap member. The apparatus body is usable in any of a vertical or horizontal arrangement. The recording head has a nozzle face with nozzles to eject liquid droplets. The recording head is placed in the apparatus body so as to eject the liquid droplets obliquely downward in any of the vertical or horizontal arrangement of the apparatus body. The recording head has suction ports at opposed end portions in a longitudinal direction of the nozzle face. The cap member caps the nozzle face of the recording head. The cap member has a liquid chamber member, passages, and separation films. The liquid chamber member includes a liquid chamber to accommodate liquid. The passages are disposed at opposed ends in a longitudinal direction of the cap member to communicate an inside of the cap member with the liquid chamber. The separation films are disposed in the passages. The liquid chamber member has a release port communicate an inside of the liquid chamber with an outside of the liquid chamber, another separation film at the release port to separate gas from liquid, and a release valve to open and close the release port.

In at least one exemplary embodiments of this disclosure, there is provided an image forming apparatus including a recording head and a cap member. The recording head has a nozzle face with nozzles to eject liquid droplets. The recording head has suction ports at opposed end portions in a longitudinal direction of the nozzle face. The cap member caps the nozzle face of the recording head.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
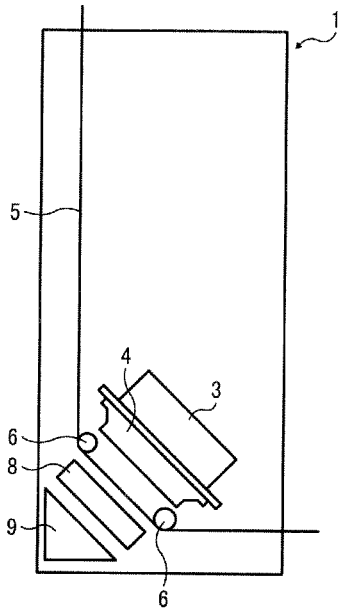
FIG. 1 is a side view of an image forming apparatus according to at least one exemplary embodiment of this disclosure in a vertical arrangement.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, wood, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below. First, an image forming apparatus according to at least one exemplary embodiment of this disclosure is described with reference to FIGS. 1 to 3.

Figure 2:
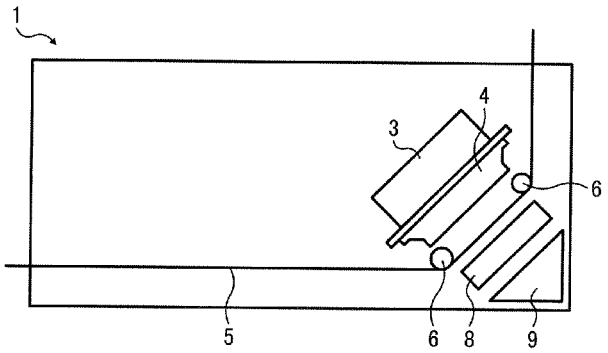
FIG. 2 is a side view of the image forming apparatus of FIG. 1 in a horizontal arrangement.
Figure 3:
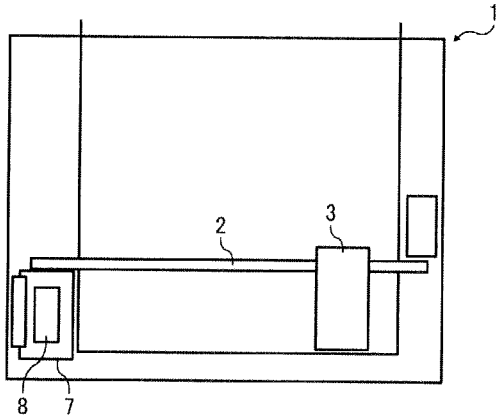
FIG. 3 is a front view of the image forming apparatus of FIG. 1 in the vertical arrangement.

FIG. 1 is a side view of an image forming apparatus according to at least one exemplary embodiment of this disclosure in a vertical arrangement. FIG. 2 is a side view of the image forming apparatus according of FIG. 1 in a horizontal arrangement. FIG. 3 is a front view of the image forming apparatus of FIG. 1 in the vertical arrangement.

The image forming apparatus includes, for example, an apparatus body 1, a guide member 2, a carriage 3, a recording head 4, guide rollers 6, a maintenance device 7, a cap (suction cap) 8, a waste liquid tank 9, and a transport device. The image forming apparatus includes the carriage 3 movably supported by the guide member 2 in the apparatus body 1. The carriage 3 mounts the recording head 4 to eject liquid droplets. The recording head 4 is mounted on the carriage 3 so as to eject droplets obliquely downward.

The transport device transports a sheet 5, and the guide rollers 6 intermittently transport the sheet 5 so that the sheet 5 opposes the recording head 4. While the carriage 3 is moved for scanning, the recording head 4 ejects liquid droplets to form an image on the sheet 5.

In a non-recording area at one end in a scanning direction of the carriage 3 is disposed the maintenance device 7 to maintain and recover conditions of nozzles of the recording head 4.

The maintenance device 7 has a cap member (e.g., the cap 8 in FIGS. 1 to 3) to cap a nozzle face of the recording head 4. The cap 8 is connected to a suction device (e.g., a suction pump) via, e.g., a suction tube. The suction device sucks waste liquid from the cap 8 and discharges such waste liquid to the waste liquid tank 9. The maintenance device 7 also includes, e.g., a wiping member to wipe the nozzle face of the recording head 4 and a dummy ejection receptacle to store liquid droplets ejected by dummy ejection in which liquid droplets not directly contributing to image formation are ejected to maintain or recover conditions of the nozzles.

The image forming apparatus is usable when the apparatus body 1 is disposed in any of a vertical arrangement as illustrated in FIG. 1 or a horizontal arrangement as illustrated in FIG. 2.

Each of the recording head 4 and the cap 8 of the maintenance device 7 is obliquely arranged in any of the vertical arrangement and the horizontal arrangement of the image forming apparatus.

Next, a first exemplary embodiment of this disclosure is described with reference to FIGS. 4 to 6.

Figure 4:
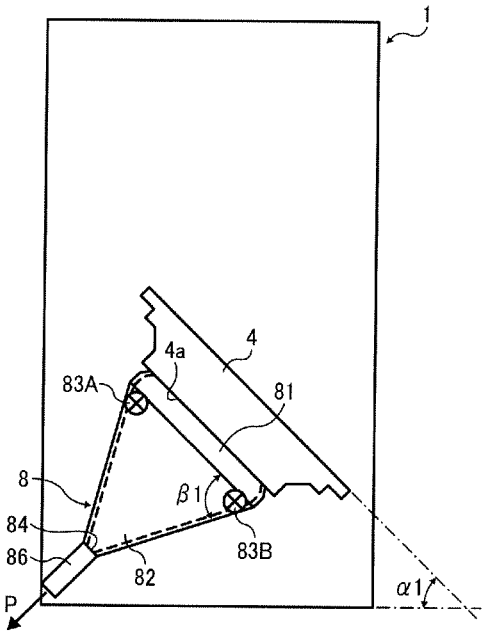
FIG. 4 is a side view of a cap and a surrounding area of the cap in an image forming apparatus according to a first exemplary embodiment of this disclosure in a vertical arrangement.

FIG. 4 is a side view of a cap 8 and a surrounding area of the cap 8 in an image forming apparatus according to the first exemplary embodiment of this disclosure in a vertical arrangement. FIG. 5 is a side view of the cap 8 and the surrounding area in the image forming apparatus of FIG. 4 in a horizontal arrangement. FIG. 6 is a front view of the cap 8 of FIG. 4. In FIGS. 4 and 5, a release valve is schematically illustrated.

The cap 8 includes, e.g., a contact portion 81 and a cap body 82. The contact portion 81 is elastically deformable and is configured to contact a nozzle face 4*a* of a recording head 4 in which nozzles are formed to eject droplets. The cap body 82 has an internal space.

The cap body 82 has a substantially triangle shape in a side face of the cap body 82. The cap body 82 has openings (release ports 83*a* in FIG. 6) at opposed end portions in a longitudinal direction parallel to a base edge of the substantially triangle shape of the cap body 82. The cap body 82 also has release valves 83A and 83B (referred to as "release valves 83" unless distinguished) to open and close the release ports 83*a*. The cap body 82 has a suction port 84 at an apex portion of the substantially triangle shape of the cap body 82. The suction port 84 is connected to the suction device (e.g., a suction pump) via, e.g., a suction tube 86 as indicated by an arrow P in FIGS. 4 to 6.

In any of the vertical or horizontal arrangement of the apparatus body 1, at least one of the release ports 83*a* openable and closable with the release valves 83A and 83B is disposed at a position(s) higher than the suction port 84.

Figure 5:
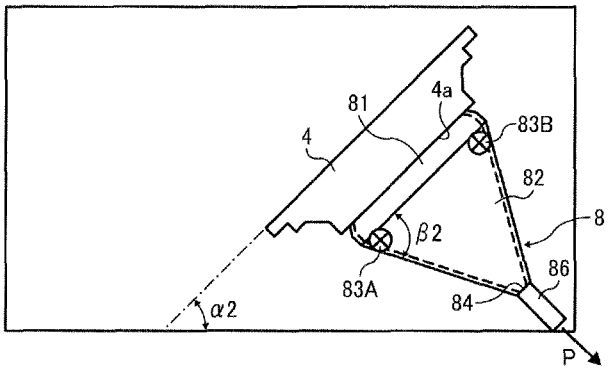
FIG. 5 is a side view of the cap and the surrounding area in the image forming apparatus of FIG. 4 in a horizontal arrangement.
Figure 6:
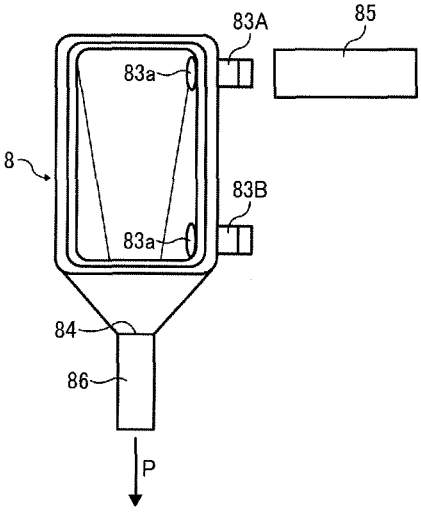
FIG. 6 is a front view of the cap of FIG. 4.

For the cap 82 illustrated in FIGS. 4 to 6, in any of the vertical or horizontal arrangement of the apparatus body 1, both of the release ports 83*a* openable and closable with the release valves 83A and 83B are disposed at positions higher than the suction port 84.

In such a case, an angle $\alpha$ ($\alpha 1$ or $\alpha 2$) formed by the nozzle face 4*a* of the recording head 4 and a horizontal plane (e.g., a plane on which the apparatus body 1 is placed) and an angle $\beta$ ($\beta 1$ or $\beta 2$) formed by a nozzle-face-side edge and a ground-face side edge of the cap body 82 of the cap 8 have a relationship of $\alpha<\beta$. For example, for the image forming apparatus illustrated in FIGS. 4 to 6, the angles $\alpha$ and $\beta$ have relationships of $\alpha 1 \leq \beta 1$ and $\alpha 2<\beta 2$. For such relationships, the end portions of the cap 8 in the longitudinal direction are disposed positions higher than the suction port 84. For example, for the image forming apparatus illustrated in FIGS. 4 to 6, the recording head 4 is disposed in the apparatus body 1 so that the angle $\alpha$ is 45 degrees.

As illustrated in FIG. 6, the release valves 83A and 83B are opened and closed by a release assembly 85 mounted on the apparatus body 1. The release assembly 85 includes, for example, a solenoid, a motor, and/or gears.

Next, sucking operation on a recording head according to at least one exemplary embodiment of this disclosure is described with reference to FIG. 7.

With a recording head 4 and a cap 8 opposing each other, at S101 the cap 8 is moved toward the recording head 4 to cap a nozzle face 4*a* of the recording head 4. With the nozzle face 4*a* capped with the cap 8, at S102 a suction device (e.g., a suction pump) is driven to suck liquid (e.g., ink) from nozzles of the recording head 4, thus discharging liquid into the cap 8. Such an operation is referred to as "nozzle suction" and "head suction").

At S103, a release valve 83 is opened by a release assembly 85 to open the inside of the cap 8 to the atmosphere. With the inside of the cap 8 open to the atmosphere, at S104 the suction device is driven to discharge liquid (e.g., ink) from the inside of the cap 8 into a waste liquid tank 9 as waste liquid (waste ink).

At S105, the cap 8 is detached from the nozzle face 4*a* of the recording head 4 (decapping).

Figure 7:
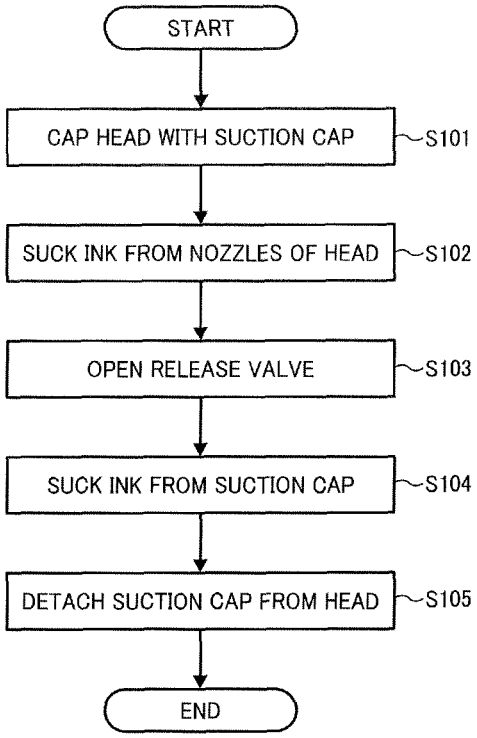
FIG. 7 is a flowchart of sucking operation on nozzles of a recording head according to at least one exemplary embodiment of this disclosure.

For example, for the image forming apparatus according to the first exemplary embodiment, when the inside of the cap 8 is opened to the atmosphere in the process of FIG. 7, any of the release ports 83*a* openable and closable with the release valves 83A and 83B is placed at a position higher than the suction port 84 regardless of whether the apparatus body 1 is disposed in the vertical or horizontal arrangement. Such a configuration can reliably open the inside of the cap 8 to the atmosphere by releasing the release valves 83 (opening the release ports 83*a*) placed at the positions higher than the suction port 84.

Then, with the nozzle face 4*a* capped with the cap 8, the inside of the cap 8 is opened to the atmosphere and sucked by the suction device. As a result, waste liquid discharged into the inside of the cap 8 can be reliably discharged to the outside of the cap 8, and then the nozzle face 4*a* of the recording head 4 is capped with the cap 8, thus preventing waste liquid from overflowing from the cap 8.

Regardless of whether the apparatus body 1 is disposed in the vertical or horizontal arrangement, such a configuration can prevent waste liquid from overflowing from the cap 8 and minimize or eliminate residual waste liquid in the cap 8, thus allowing a reliable maintenance and recovery operation.

Next, a comparative example is described with reference to FIGS. 8A and 8B.

Figure 8A:
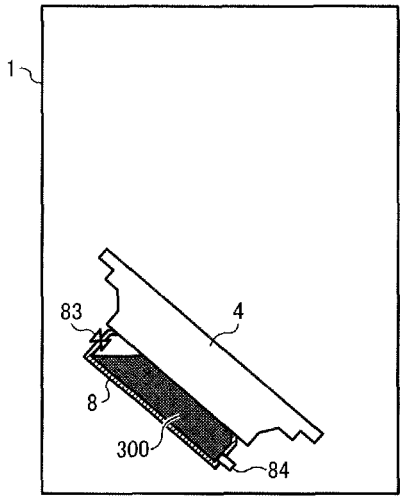
FIG. 8A is a side view of a cap and a surrounding area of the cap in an image forming apparatus according to a comparative example in a vertical arrangement.
Figure 8B:
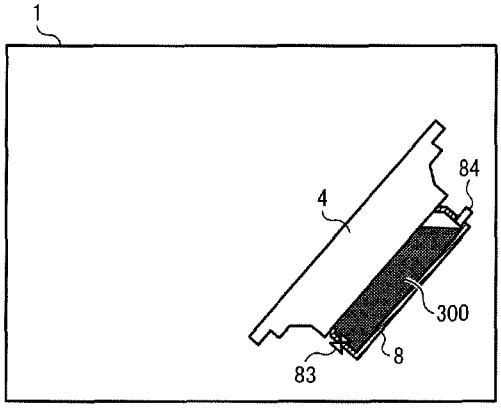
FIG. 8B is a side view of the cap and the surrounding area of FIG. 8A in a horizontal arrangement.

In the comparative example illustrated in FIGS. 8A and 8B, a cap 8 has a release valve 83 and a suction port 84. The release valve 83 includes a release port and disposed at an end portion of the cap 8. The suction port 84 is disposed at an opposed end portion of the cap 8 and connected to a suction pump.

For such a configuration, for example, in a vertical arrangement illustrated in FIG. 8A, the release valve 83 is placed at a position higher than the suction port 84. As a result, after waste liquid 300 is discharged into the cap 8 by nozzle suction, the release valve 83 is opened to release the inside of the cap 8 to the atmosphere. Thus, with the inside of the cap 8 open to the atmosphere, the waste liquid 300 in the cap 8 can be sucked and discharged from the suction port 84.

By contrast, in a horizontal arrangement illustrated in FIG. 8B, the release valve 83 is placed at a position lower than the suction port 84. In such a case, when waste liquid 300 is discharged into the cap 8 by nozzle suction, the release port is covered with the waste liquid 300. As a result, if the release valve 83 is opened, the waste liquid 300 would flow out from the release valve 83. Thus, in this comparative example, after nozzle suction, with the inside of the cap 8 opened to the atmosphere by the release valves 83, the waste liquid 300 discharged into the cap 8 is not discharged from the cap 8 by suction of the suction pump.

If the suction pump sucks the waste liquid 300 from the cap 8 with the inside of the cap 8 not opened to the atmosphere, liquid (ink) would be continuously discharged from nozzles of a recording head 4 into the cap 8, thus hampering a maintenance and recovery operation. In addition, if the cap 8 is decapped from the recording head 4 with discharged waste liquid 300 included in the cap 8, the waste liquid 300 would be flown out from the cap 8 since the cap 8 is tilted.

In other words, for the configuration of the comparative example, in the vertical or horizontal arrangement, the apparatus body 1 is not usable in a state in which liquid droplets are ejectable obliquely downward from the recording head 4.

By contrast, for the above-described first exemplary embodiment, in any of the vertical or horizontal arrangement, the apparatus body 1 can be arranged so that liquid droplets are ejectable obliquely downward from the recording head 4, and the cap 8 is openable to the atmosphere. Such a configuration allows the apparatus body 1 to be used in any of the vertical or horizontal arrangement, and can perform a reliable maintenance and recovery operation.

For the first exemplary embodiment, regardless of the arrangement of the apparatus body 1, the release valves 83A and 83B are placeable at the same position (for example, the release valve 83B is movable to a position of the release valve 83A). By contrast, in a case in which the release valves 83A and 83B are not placeable at the same position due to the arrangement of the apparatus body 1, the release assembly 85 may be movable in the apparatus body 1 or a plurality of release assemblies 85 corresponding to the respective release valves 83A and 83B may be provided.

Figure 10:
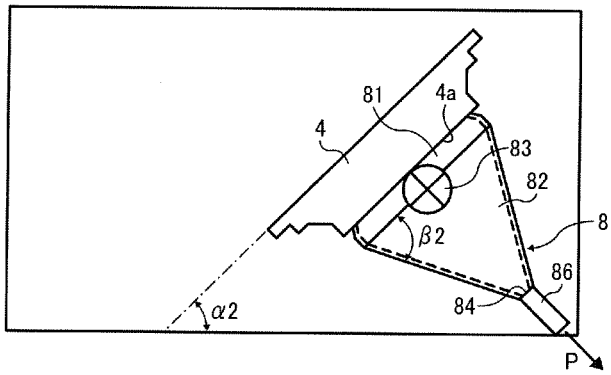
FIG. 10 is a side view of the cap and the surrounding area in the image forming apparatus of FIG. 9 in a horizontal arrangement.
Figure 11:
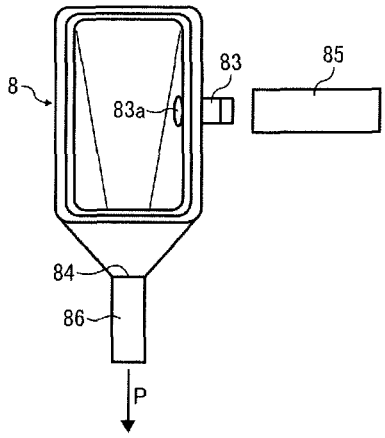
FIG. 11 is a front view of the cap of FIG. 9.

Next, a second exemplary embodiment of this disclosure is described with reference to FIGS. 9 to 11.

Figure 9:
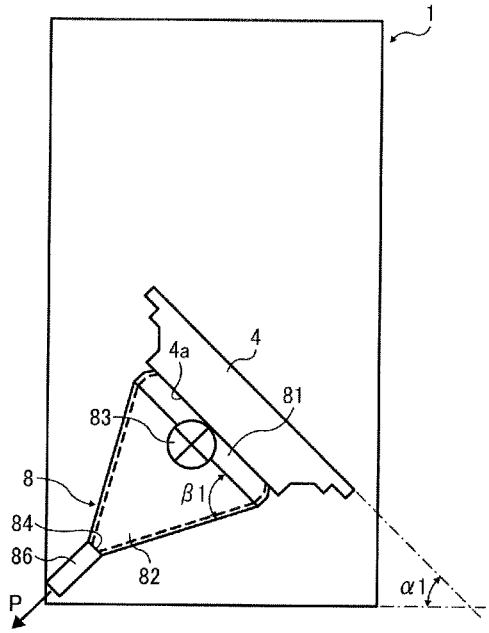
FIG. 9 is a side view of a cap and a surrounding area of the cap in an image forming apparatus according to a second exemplary embodiment of this disclosure in a vertical arrangement.

FIG. 9 is a side view of a cap 8 and a surrounding area of the cap 8 in an image forming apparatus according to the second exemplary embodiment of this disclosure in a vertical arrangement. FIG. 10 is a side view of the cap 8 and the surrounding area in the image forming apparatus of FIG. 9 in a horizontal arrangement. FIG. 11 is a front view of the cap 8 of FIG. 9.

For the second exemplary embodiment, the cap 8 has a release port 83*a* at a middle portion in a longitudinal direction of the cap 8, and the release port is openable and closable with a release valve 83. In such a configuration, as with the first exemplary embodiment, an angle $\alpha$ formed by a nozzle face 4*a* of a recording head 4 and a horizontal plane (e.g., a plane on which an apparatus body 1 is placed) and an angle $\beta$ formed by a nozzle-face-side edge and a ground-face side edge of a cap body 82 of the cap 8 have a relationship of $\alpha<\beta$.

For such a configuration, as with the first exemplary embodiment, waste liquid discharged into the cap 8 is stored in the cap body 82. By opening the release valve 83 to release the inside of the cap 8 to the atmosphere, waste liquid can be discharged from the cap 8.

Next, differences between the first exemplary embodiment and the second exemplary embodiment are described with reference to FIGS. 12A and 12B.

Figure 12A:
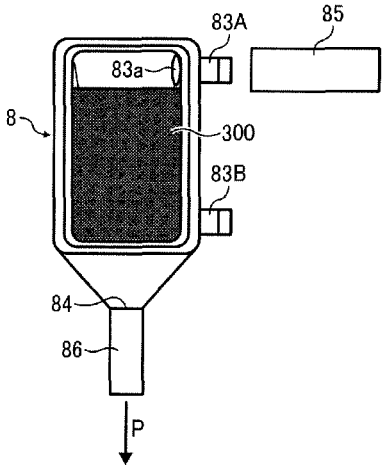
FIG. 12A is a front view of the cap of the image forming apparatus according to the first exemplary embodiment.
Figure 12B:
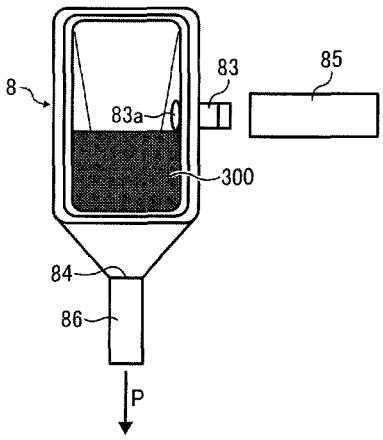
FIG. 12B is a front view of the cap of the image forming apparatus according to the second exemplary embodiment.

FIG. 12A is a front view of the cap 8 of the image forming apparatus according to the first exemplary embodiment. FIG. 12B is a front view of the cap 8 of the image forming apparatus according to the second exemplary embodiment.

For the first exemplary embodiment, the cap 8 has the release valves 83A and 83B at opposed end portions in the longitudinal direction of the cap 8, thus allowing the release valves 83 to be selectively open. Such a configuration allows the cap 8 to store waste liquid 300 up to a position near an upper one of the release valves 83A and 83B corresponding to an upper one of the release ports 83*a* placed at an uppermost position of the cap 8.

By contrast, for the second exemplary embodiment, the cap 8 has the release valve 83 at the middle portion in the longitudinal direction of the cap 8. As a result, the cap 8 can store waste liquid 300 up to a position near and below the release valve 83 disposed at the middle portion in the longitudinal direction of the cap 8.

In other words, for the second exemplary embodiment, when the release valve 83 is opened to open the release port 83*a* after nozzle suction, waste liquid 300 would flow into the release port 83*a* if the waste liquid 300 is stored up to a position of the release port 83*a* opened. Hence, in the second exemplary embodiment, the waste liquid 300 stored in the cap 8 is maintained at positions lower than the release port 83*a*.

As a result, the cap 8 in the second exemplary embodiment can store a smaller amount of waste liquid than the cap 8 of the first exemplary embodiment.

When the configuration of the second exemplary embodiment is employed, for example, the amount of liquid sucked or ejected into the cap 8 is controlled within a range in which the amount of waste liquid is lower than the release port 83*a*. In addition, for example, by setting a standby time after nozzle suction, the release valve 83 is controlled to open the release port 83*a* after waste liquid is securely collected by gravitational force in an area lower than the release port 83*a*.

Next, a third exemplary embodiment of this disclosure is described with reference to FIGS. 13 and 14.

Figure 13:
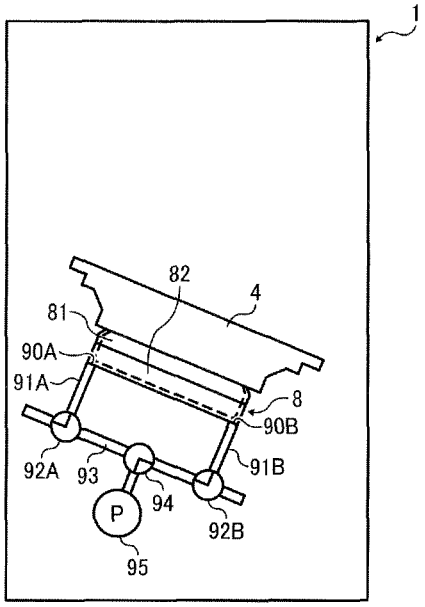
FIG. 13 is a side view of a cap and a surrounding area of the cap in an image forming apparatus according to a third exemplary embodiment of this disclosure in a vertical arrangement.

FIG. 13 is a side view of a cap 8 and a surrounding area of the cap 8 in an image forming apparatus according to the third exemplary embodiment of this disclosure in a vertical arrangement. FIG. 14 is a side view of the cap 8 and the surrounding area in the image forming apparatus of FIG. 13 in a horizontal arrangement.

In this third exemplary embodiment, the cap 8 has openings 90A and 90B servings as a suction port and a release port at opposed end portions in a longitudinal direction of the cap 8. The cap 8 also has passages 91A and 91B communicated with the openings 90. Each of the passages 91A and 91B is communicated with the atmosphere via switching valves (in this exemplary embodiment, three-way valve 92A and 92B) and connected to a suction pump 95 via a passage 93 and a three-way valve 94.

For such a configuration, when an apparatus body 1 is used in a vertical arrangement, as illustrated in FIG. 13, the opening 90A communicated with the passage 91A is placed higher than the opening 90B communicated with the passage 91B.

Hence, the three-way valve 94 is switched to a passage 91B side, the three-way valve 92B is switched to a suction pump 95 side, and the three-way valve 92A is switched to a suction pump 95 side. In such a state, nozzle suction is performed. Then, the three-way valve 92A is switched to an atmosphere side to open the inside of the cap 8 to the atmosphere via the passage 91A. Thus, waste liquid in the cap 8 is discharged by suction of the suction pump 95.

Figure 14:
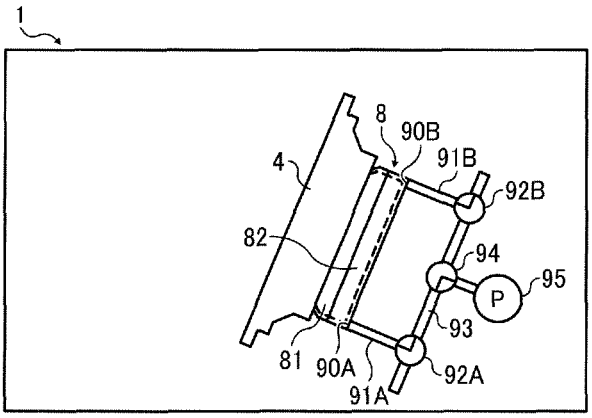
FIG. 14 is a side view of the cap and the surrounding area in the image forming apparatus of FIG. 13 in a horizontal arrangement.

By contrast, when the apparatus body 1 is used in a horizontal arrangement, as illustrated in FIG. 14, the opening 90A communicated with the passage 91A is placed lower than the opening 90B communicated with the passage 91B.

Hence, the three-way valve 94 is switched to a passage 91A side, the three-way valve 92A is switched to the suction pump 95 side, and the three-way valve 92B is switched to the suction pump 95 side. In such a state, nozzle suction is performed. Then, the three-way valve 92B is switched to an atmosphere side to open the inside of the cap 8 to the atmosphere via the passage 91B. Thus, waste liquid in the cap 8 is discharged by suction of the suction pump 95.

As described above, for the third exemplary embodiment, the openings 90A and 90B are disposed at the opposed end portions in the longitudinal direction of the cap member (cap 8). An upper one of the openings 90 placed in accordance with an arrangement of the apparatus body 1 is used as a release valve, and a lower one of the openings 90 is used as a suction port (portion). Such a configuration can obtain operational effects equivalent to those of the first exemplary embodiment.

Next, a fourth exemplary embodiment of this disclosure is described with reference to FIGS. 15 and 16.

Figure 15:
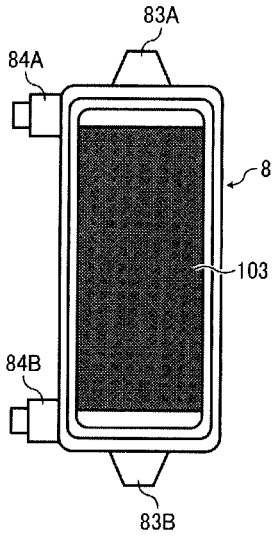
FIG. 15 is a front view of a cap in an image forming apparatus according to a fourth exemplary embodiment of this disclosure.
Figure 16:
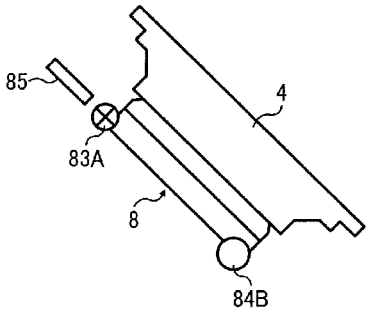
FIG. 16 is a side view of the cap and a surrounding area of the cap in the image forming apparatus of FIG. 15.

FIG. 15 is a front view of a cap 8 and a surrounding area of the cap 8 in an image forming apparatus according to the fourth exemplary embodiment of this disclosure. FIG. 16 is a side view of the cap 8 and the surrounding area in the image forming apparatus of FIG. 15.

In this fourth exemplary embodiment, as illustrated in FIG. 15, the cap 8 has release valves 83A and 83B and suction ports 84A and 84B in opposed end portions in a longitudinal direction of the cap 8. Each of the release valves 83A and 83B includes a release port.

For such a configuration, in accordance with an arrangement of the apparatus body 1, an upper one of the release valves 83 including the release port is opened to release the inside of the cap 8 to the atmosphere, and waste liquid is sucked from a lower one of the suction ports 84A and 84B. For example, in a state illustrated in FIG. 16, with the upper one of the release valves 83A and 83B, i.e., the release valve 83A in FIG. 16 opened by a release assembly 85, waste liquid is sucked from the lower one of the suction ports 84A and 84B, i.e., the suction port 84A in FIG. 16.

Such a configuration can obtain operational effects equivalent to those of the first exemplary embodiment.

Next, a fifth exemplary embodiment of this disclosure is described with reference to FIGS. 17 to 21.

Figure 17:
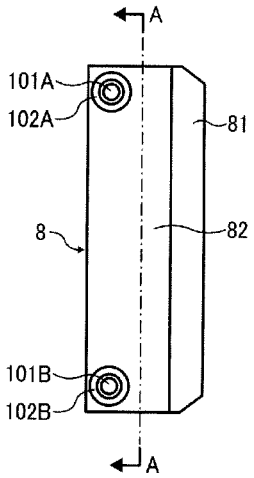
FIG. 17 is a side view of a cap in an image forming apparatus according to a fifth exemplary embodiment of this disclosure.
Figure 18:
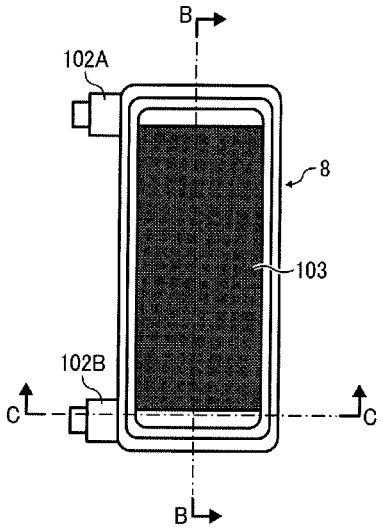
FIG. 18 is a front view of the cap of FIG. 17.
Figure 19:
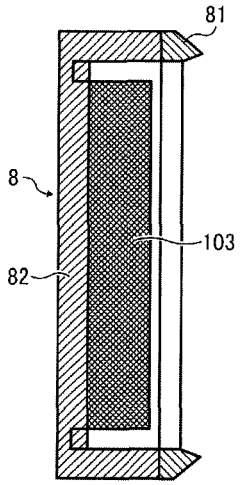
FIG. 19 is a cross-sectional view of the cap cut along a line B-B of FIG. 18.
Figure 20:
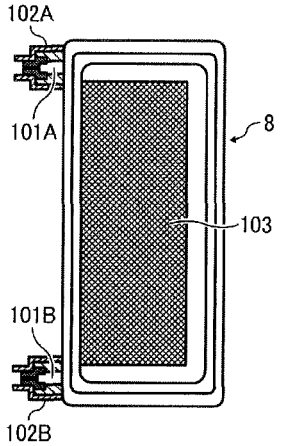
FIG. 20 is a cross-sectional view of the cap cut along a line A-A of FIG. 17.
Figure 21:
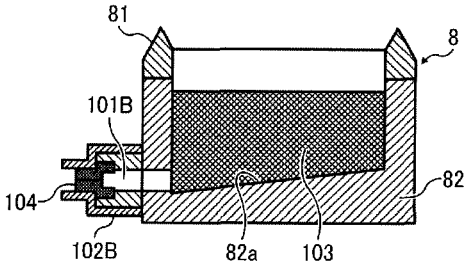
FIG. 21 is a cross-sectional view of the cap cut along a line C-C of FIG. 18.

FIG. 17 is a side view of a cap 8 in the fifth exemplary embodiment. FIG. 18 is a front view of the cap 8 of FIG. 17. FIG. 19 is a cross-sectional view of the cap 8 cut along a line B-B of FIG. 18. FIG. 20 is a cross-sectional view of the cap 8 cut along a line A-A of FIG. 17. FIG. 21 is a cross-sectional view of the cap 8 cut along a line C-C of FIG. 18.

In this fifth exemplary embodiment, the cap 8 has a side face at which connectors 102A and 102B are disposed at opposed end portions in a longitudinal direction of the cap 8. The connectors 102A and 102E (collectively referred to as connectors 102 unless distinguished) include openings, e.g., holes 101A and 101B, respectively, illustrated in FIGS. 17 and 20. Each of the holes 101A and 101E (collectively referred to as holes 101 unless distinguished) is sealed with an elastic member, e.g., a seal member 104 in FIG. 21 and detachably connectable relative to an external connection member of, e.g., a suction device or a release assembly.

In this fifth exemplary embodiment, the cap 8 has an absorbing member 103 in a cap body 82. An internal bottom face 82*a* of the cap body 82 is a slant face slanted toward the holes 101A and 101B to minimize a residual of waste liquid.

Next, an example of a connector of a release assembly connectable to the hole 101 of the connector 102 of the cap 8 in the fifth exemplary embodiment of this disclosure is described with reference to FIGS. 22A, 22B, and 22C.

Figure 22A:
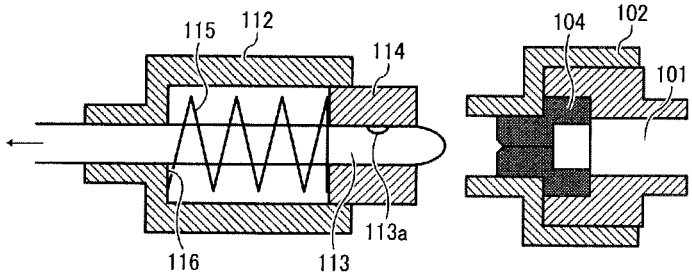
FIGS. 22A, 22B, and 22C are cross-sectional views of a connector of a release assembly and a connector of the cap of FIG. 17.
Figure 22B:
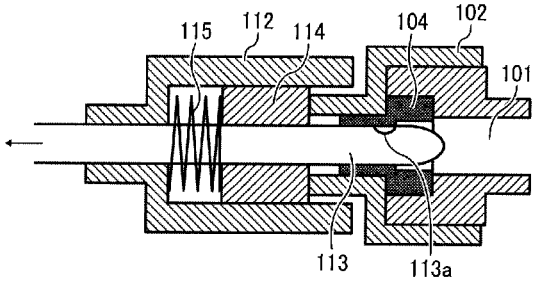
Figure 22C:
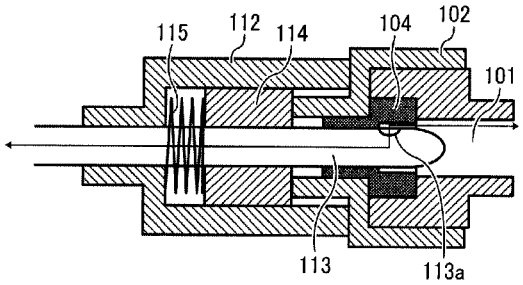

FIGS. 22A, 22B, and 22C are cross-sectional views of a connector 112 of a release assembly and the connector 102 of the cap 8.

The connector 102 of the cap 8 includes the elastically deformable seal member 104 to seal the hole 101.

The connector 112 of the release assembly (e.g., release assembly 85 in the above-described exemplary embodiments) includes a hollow needle 113 serving as a connection member (connection passage member). An elastic member 114 is movably disposed at a front end portion of the hollow needle 113 in a direction toward the connector 102. The connector 112 includes a spring 115 to urge the elastic member 114 in the direction toward the connector 102. The hollow needle 113 has a hole 113*a* to communicate the inside of the hollow needle 113 with the outside of the hollow needle 113 at a side face perpendicular to a direction in which the hollow needle 113 advances or retracts relative to the connector 102.

A front end portion of the connector 102 of the cap 8 in a direction toward the connector 112 of the release assembly has a shape to fit into the connector 112 of the release assembly while pushing the elastic member 114.

By moving the connector 112 of the release assembly toward the cap 8 from a state illustrated in FIG. 22A, as illustrated in FIG. 22B, the front end portion of the connector 102 of the cap 8 is introduced into the connector 112 of the release assembly while pushing an internal member (the elastic member 114) of the connector 112. Meanwhile, the hollow needle 113 is introduced into the inside of the connector 102 of the cap 8 while being inserted into the seal member 104 of the cap 8. In such a state, the hole 113*a* of the hollow needle 113 is sealed by the seal member 104 and a hole 101 of the cap 8 is not communicated with the atmosphere.

As illustrated in FIG. 22C, with the front end portion of the connector 102 of the cap 8 sealed by the elastic member 114, the hole 113*a* of the hollow needle 113 is introduced into the hole 101 beyond the seal member 104. As a result, the hole 101 of the cap 8 is communicated with the atmosphere via the hole 113*a* of the hollow needle 113 and the inside of the hollow needle 113.

Next, an example of a connector of a suction device connectable to the hole 101 of the connector 102 of the cap 8 in the fifth exemplary embodiment of this disclosure is described with reference to FIGS. 23A, 23B, and 23C.

Figure 23A:
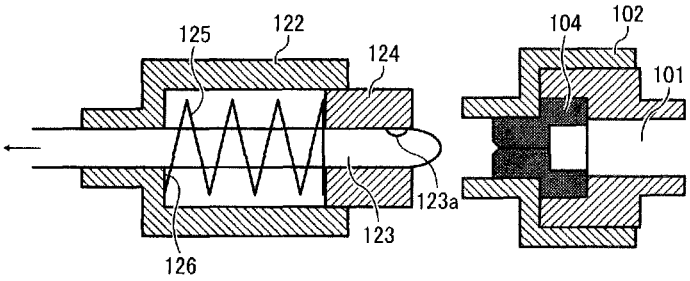
FIGS. 23A, 23B, and 23C are cross-sectional views of a connector of a suction device and a connector of the cap of FIG. 17.
Figure 23B:
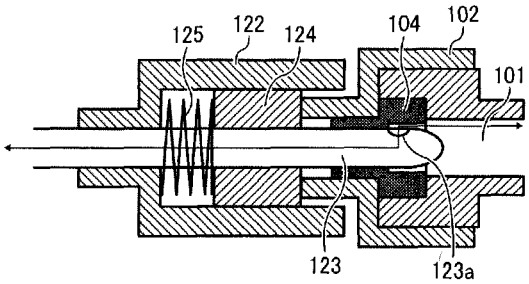
Figure 23C:
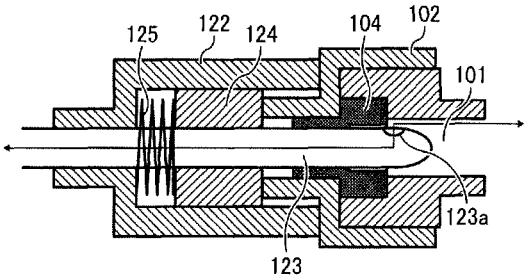

FIGS. 23A, 23B, and 23C are cross-sectional views of a connector 122 of a release assembly and the connector 102 of the cap 8 in the fifth exemplary embodiment of this disclosure.

Like the connector 112 of the release assembly, the connector 122 of the suction device (e.g., the suction pump 95 in the above-described third exemplary embodiment) includes a hollow needle 123 serving as a connection member (connection passage member). An elastic member 124 is movably disposed at a front end portion of the hollow needle 123 in a direction toward the connector 1. The connector 122 includes a spring 125 to urge the elastic member 124 in the direction toward the connector 102 of the cap 8.

The hollow needle 123 has a hole 123*a* to communicate the inside of the hollow needle 113 with the outside of the hollow needle 113 at a side face perpendicular to a direction in which the hollow needle 113 advances or retracts relative to the connector 102. The hole 123*a* of the hollow needle 123 is disposed at a position closer to a front tip of the hollow needle 123 than the hole 113*a* of the hollow needle 113 of the connector 112 of the above-described release assembly.

A front end portion of the connector 102 of the cap 8 in a direction toward the connector 122 of the release assembly has a shape to fit into the connector 122 of the release assembly while pushing the elastic member 124.

By moving the connector 122 of the suction device toward the cap 8 from a state illustrated in FIG. 23A, as illustrated in FIG. 23B, the front end portion of the connector 102 of the cap 8 is introduced into the connector 122 of the suction device while pushing an internal member (the elastic member 124) of the connector 122. Meanwhile, the hollow needle 123 is introduced into the inside of the connector 102 of the cap 8 while being inserted into the seal member 104 of the cap 8.

As described above, the hole 123*a* of the hollow needle 123 of the suction device is disposed at a position closer to a front tip of the hollow needle 123 than the hole 113*a* of the hollow needle 113 of the connector 112 of the release assembly. In such a state illustrated in FIG. 23B, the sealing of the hole 123*a* of the hollow needle 123 by the seal member 104 is released, and the hole 101 of the cap 8 is communicated with the suction device (e.g., the suction pump 95 in the above-described exemplary embodiments) via the hole 123*a* and the inside of the hollow needle 123.

With the hole 101 of the cap 8 communicated with the suction device via the hole 123*a* and the inside of the hollow needle 123, as illustrated in FIG. 23C, the hollow needle 123 is introduced into the hole 101.

In other words, the positions of the holes in the hollow needles are different between the release assembly and the suction device. Such a configuration allows connection of the suction device or the release assembly with the cap to be controlled in accordance with the depth of the connection. As illustrated in FIGS. 23A, 23B, and 23C, when the suction device is relatively shallowly connected to the cap, nozzle suction can be performed in such a shallow connection state. By contrast, as illustrated in FIGS. 22A, 22B, and 22C, when the release assembly is relatively deeply connected to the cap, with the inside of the suction opened to the atmosphere in such a deep connection state, waste liquid in the cap can be sucked and discharged by driving of the suction pump. Such a configuration allows head suction, opening of the inside of the cap to the atmosphere, and suction of the inside of the cap to be simply and serially performed.

As described above, for this exemplary embodiment, the inside of the cap can be sucked or opened to the atmosphere by connecting the cap to external devices, i.e., the suction device and the release assembly.

Figure 24A:
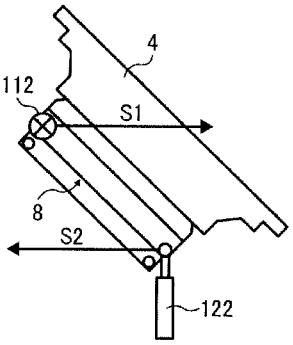
FIG. 24A is a side view of an example of the connector of the release assembly and the connector of the suction device independently movable in a horizontal direction.
Figure 24B:
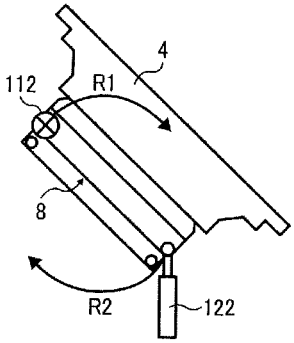
FIG. 24B is a side view of an example of the connector of the release assembly and the connector of the suction device connected to each other at a certain distance.

Alternatively, for example, as illustrated in FIGS. 24A and 24B, the suction device and the release assembly may be interchangeably connectable to the respective holes 102 of the cap 8. FIG. 24A shows a configuration in which each of the connector 112 of the release assembly and the connector 122 of the suction device is independently moved straight in a horizontal direction indicated by an arrow S1 or S2 to be switchingly connected to the respective holes 102 of the cap 8. FIG. 24B is a configuration in which each of the connector 112 of the release assembly and the connector 122 of the suction device are connected to each other at a certain distance and rotated in a direction indicated by an arrow R1 or R2 to be switchingly connected to the respective holes 102 of the cap 8.

Such a configuration can minimize the number of holes to be provided with the cap 8, thus minimizing factors that could reduce the sealing performance.

Next, a sixth exemplary embodiment of this disclosure is described with reference to FIGS. 25 and 26.

Figure 25:
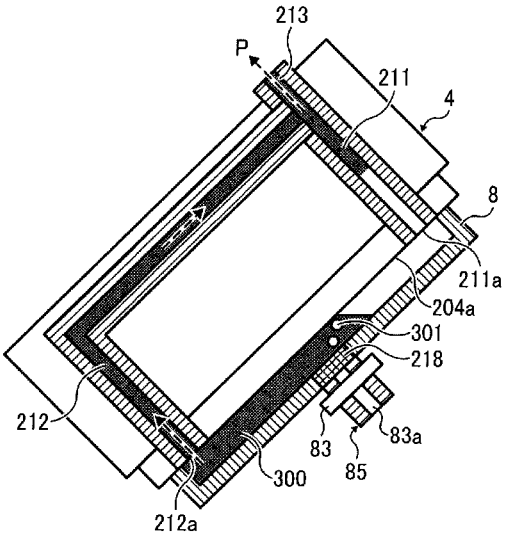
FIG. 25 is a schematic cross-sectional view of a recording head and a cap of an image forming apparatus according to a sixth exemplary embodiment of this disclosure in a vertical arrangement of an apparatus body.

FIG. 25 is a schematic cross-sectional view of a recording head and a cap of an image forming apparatus according to the sixth exemplary embodiment in a vertical arrangement of an apparatus body. FIG. 26 is a schematic cross-sectional view of the recording head and the cap of FIG. 25 in a horizontal arrangement of the apparatus body.

A recording head 4 has respective suction ports 211*a* and 212*a* at opposed end portions in a longitudinal direction of a nozzle face 4*a*. The suction ports 211*a* and 212*a* are connected to a common passage 213 via suction passages 211 and 212, respectively. The common passage 213 is connected to a suction device (e.g., a suction pump) as indicated by an arrow P in FIGS. 25 and 26.

A cap 8 is configured to cap the nozzle face 4*a* of the recording head 4 including the suction ports 211*a* and 212*a*.

A release assembly 85 is mounted on a middle portion of the cap 8 in a longitudinal direction of the cap 8. The release assembly 85 includes a release port 83*a* and a release valve 83. The release port 83*a* is a release passage through which the inside of the cap 8 is to be opened to the atmosphere. The release valve 83 opens and closes the release port 83*a*. A separation film 218 is disposed between the release port 83*a* and the cap 8 to separate gas from liquid.

For such a configuration, when nozzle suction is performed, the suction device is driven with the release valve 83 closed. As a result, the inside of the cap 8 is sucked from the suction ports 211*a* and 212*a* and liquid is discharged from nozzles into the cap 8.

When the suction device is driven with the release valve 83 open, air is introduced into the cap 8 through the separation film 218. Waste liquid 300 in the cap 8 is discharged from at least one of the suction port 211*a* or the suction port 212*a* via the suction passages 211 and 212 and the common passage 213.

Since the separation film 218 is provided as described above, such a configuration can discharge the waste liquid 300 from the inside of the cap 8 while preventing the waste liquid 300 from being introduced into the release port 83*a*.

Figure 26:
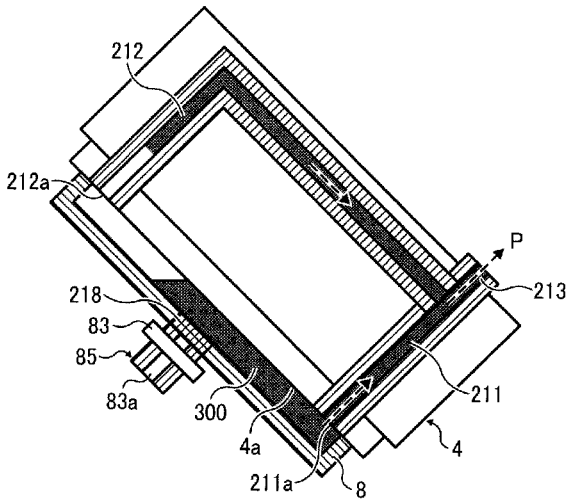
FIG. 26 is a schematic cross-sectional view of the recording head and the cap of FIG. 25 in a horizontal arrangement of the apparatus body.

As described above, when the apparatus body 1 is disposed in any of the vertical arrangement illustrated in FIG. 25 or the horizontal arrangement illustrated in FIG. 26, such a configuration allows the inside of the cap 8 to be opened to the atmosphere with the nozzle face 4*a* capped with the cap 8. Thus, like the first exemplary embodiment, when the apparatus body 1 is disposed in any of the vertical arrangement or the horizontal arrangement, the above-described configuration according to the sixth exemplary embodiment allows reliable maintenance and recovery operation.

Next, a seventh exemplary embodiment of this disclosure is described with reference to FIGS. 27A and 27B and FIGS. 28A and 28B.

Figure 27A:
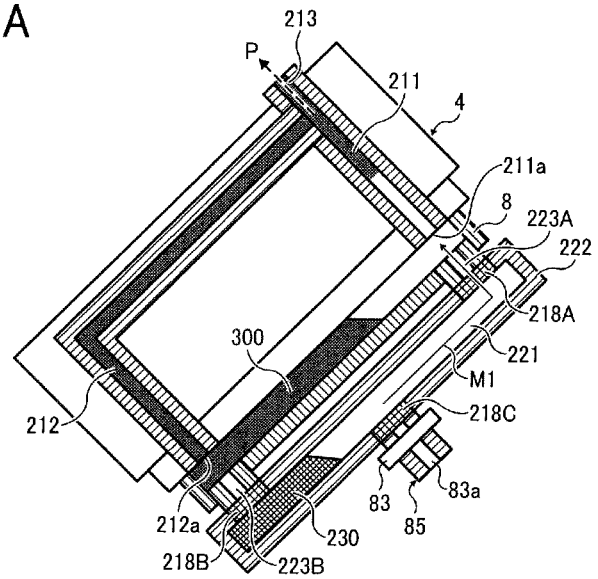
FIGS. 27A and 27B are schematic cross-sectional views of a recording head and a cap of an image forming apparatus according to a seventh exemplary embodiment of this disclosure in a vertical arrangement of an apparatus body.
Figure 27B:
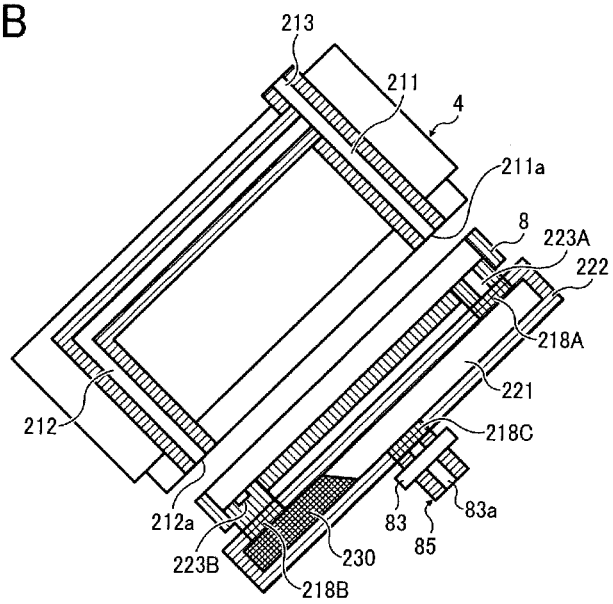
Figure 28A:
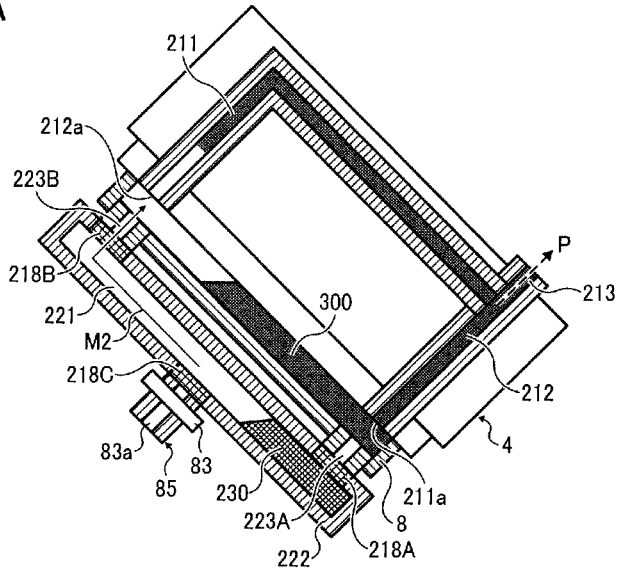
FIGS. 28A and 28B are schematic cross-sectional views of the recording head and the cap of FIGS. 27A and 27B in a horizontal arrangement of the apparatus body.
Figure 28B:
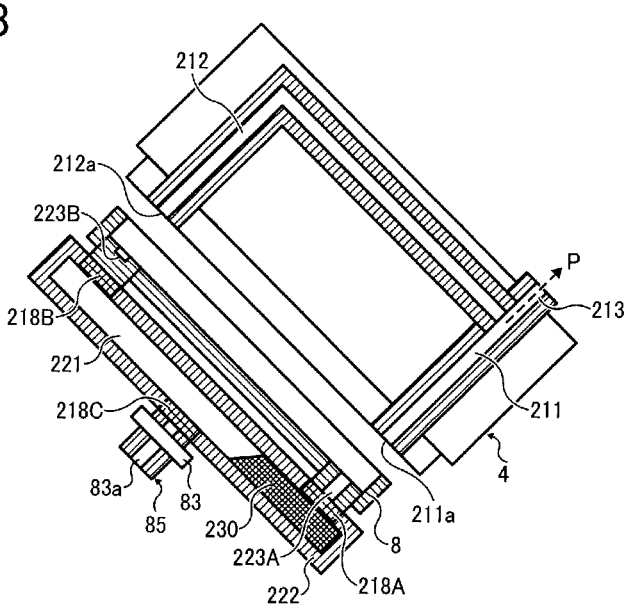

FIGS. 27A and 27B are schematic cross-sectional views of a recording head and a cap of an image forming apparatus according to the seventh exemplary embodiment in a vertical arrangement of an apparatus body. FIGS. 28A and 28B are schematic cross-sectional views of the recording head and the cap of FIGS. 27A and 27B in a horizontal arrangement of the apparatus body. Each of FIGS. 27A and 28A shows a capping state in which the recording head is capped with the cap. Each of FIGS. 27B and 28B shows a decapped state in which the cap is decapped from the recording head.

For the above-described sixth exemplary embodiment, depending on the amount of waste liquid 300 discharged in the cap 8, when air is introduced from the atmosphere into the cap 8 with the release port 83*a* placed at a position lower than a liquid level of waste liquid 300, bubbles 301 might be generated as illustrated in FIG. 25.

Hence, for the seventh exemplary embodiment, a liquid chamber member 222 including a liquid chamber 221 is mounted on a back side of the cap 8. The liquid chamber 221 of the liquid chamber member 222 is communicated with opposed end portions of the cap 8 in a longitudinal direction of the cap 8 via passages 223A and 223B. A release assembly 85 similar to the release unit in the above-described sixth exemplary embodiment is mounted on the liquid chamber member 222 to introduce air from the atmosphere into the liquid chamber 221.

The liquid chamber 221 includes liquid 230. The liquid 230 in the liquid chamber 221 is set to an amount at which the liquid level of the liquid 230 is lower than a release port 83*a*.

Separation films 218A and 218B for separating gas from liquid are disposed at a side of each of the passages 223A and 223B facing the liquid chamber 221. A separation film 218C is disposed at a side of the release port 83*a* facing the liquid chamber 221.

For such a configuration, when a recording head 4 is arranged so as to eject liquid droplets obliquely downward to the right (the apparatus body is vertically arranged) as illustrated in FIGS. 27A and 27B, the liquid 230 in the liquid chamber 221 is moved to and stays at a side proximal to the passage 223B to close the passage 223B.

In such a state, the release valve 83 is opened. When the suction pump sucks waste liquid 300 as indicated by an arrow P in FIG. 27A with a nozzle face 4*a* of the recording head 4 capped with the cap 8, air introduced from the release port 83*a* into the liquid chamber 221 is introduced into the cap 8 via the separation film 218A as indicated by an arrow M1 in FIG. 27A. Such a configuration allows waste liquid 300 to be sucked and discharged until the waste liquid 300 is empty in the cap 8.

For such a configuration, air is introduced from the release port 83*a* into the cap 8 through an upper one of the passages 223A and 223B, e.g., the passage 223A in FIG. 27A. Such a configuration can prevent air from being introduced into waste liquid 300 in the cap 8, thus preventing occurrence of bubbles.

Likewise, when the recording head 4 is arranged so as to eject liquid droplets obliquely downward to the left (the apparatus body is horizontally arranged) as illustrated in FIGS. 28A and 28B, the liquid 230 in the liquid chamber 221 is moved to and stays at a side proximal to the passage 223A to close the passage 223A.

In such a state, when the suction pump sucks waste liquid 300 as indicated by an arrow P in FIG. 28A with the release valve 83 opened, air introduced from the release port 83*a* into the liquid chamber 221 is introduced into the cap 8 via the separation film 218B as indicated by an arrow M2 in FIG. 28A. Such a configuration allows waste liquid 300 to be sucked and discharged until the waste liquid 300 is empty in the cap 8.

For such a configuration, air is introduced from the release port 83*a* into the cap 8 through an upper one of the passages 223A and 223B, e.g., the passage 223B in FIG. 28A. Such a configuration can prevent air from being introduced into waste liquid 300 in the cap 8, thus preventing occurrence of bubbles.

For such a configuration, in addition, the liquid 230 stored in the liquid chamber 221 of the liquid chamber member 222 prevents air from being introduced into the cap 8 through a lower one of 223A and 223B, e.g., the passage 223A in FIG. 28A and generating bubbles. Thus, such a configuration can prevent bubbles from adhering to the nozzle face 4*a*, thus preventing a reduction in reliability of maintenance and recovery performance.

As described above, the seventh exemplary embodiment can prevent occurrence of bubbles while obtaining operational effects equivalent to those of the sixth exemplary embodiment.

Next, an eighth exemplary embodiment of this disclosure is described with reference to FIG. 29.

Figure 29:
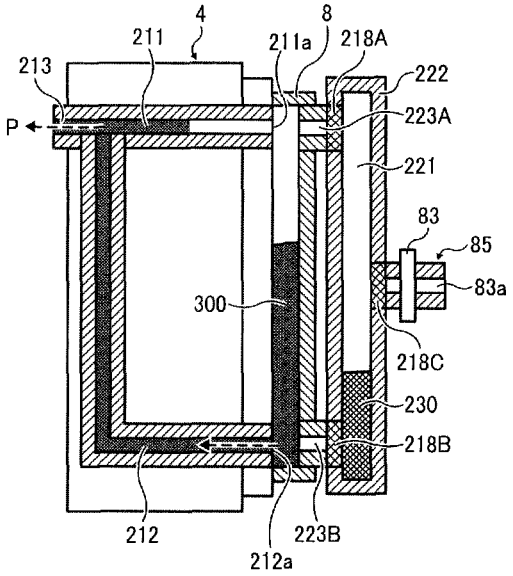
FIG. 29 is a schematic cross-sectional view of a recording head and a cap in an image forming apparatus according to an eighth exemplary embodiment of this disclosure.

FIG. 29 is a schematic cross-sectional view of a recording head and a cap in the eighth exemplary embodiment.

In this eighth exemplary embodiment, the above-described configuration of the seventh exemplary embodiment is applied to an example in which a recording head 4 is arranged so as to horizontally eject liquid droplets. The configuration and operation of the eighth exemplary embodiment are similar to the above-described seventh exemplary embodiment, and redundant descriptions thereof are omitted below.

For this eighth exemplary embodiment, a passage 223B placed at a position lower than a passage 223A is maintained in a state in which air is not introduced from the atmosphere into the passage 223B.

In such a case, a combination of the liquid 230 and the separation film 218 is determined so that the liquid 230 would not pass through the separation film 218 even if a maximum negative pressure is applied to the cap 8.

Next, a ninth exemplary embodiment of this disclosure is described with reference to FIG. 30.

Figure 30:
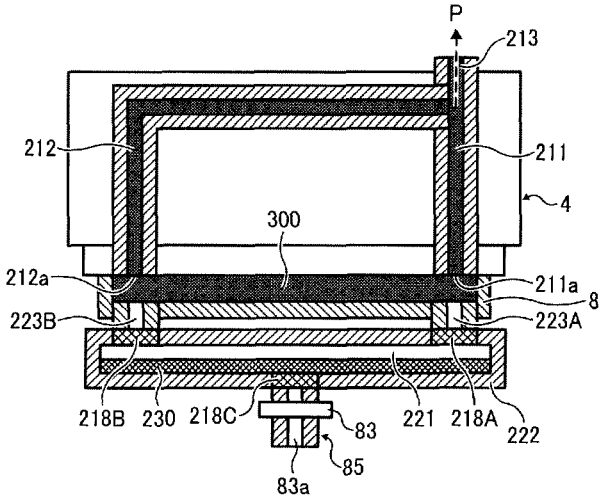
FIG. 30 is a schematic cross-sectional view of a recording head and a cap in an image forming apparatus according to a ninth exemplary embodiment of this disclosure.

FIG. 30 is a schematic cross-sectional view of a recording head and a cap in the ninth exemplary embodiment.

In this ninth exemplary embodiment, the above-described configuration of the seventh exemplary embodiment is applied to an example in which a recording head 4 is arranged so as to eject liquid droplets vertically downward.

In such a configuration, liquid 230 is moved to a side of a liquid chamber member 222 proximal to a separation film 218C (or a release port 83*a*). When a suction pump sucks waste liquid 300 with a release valve 83 opened, air can be introduced from a separation film 218C so as to pass through the liquid 230, thus allowing sucking operation with the inside of a cap 8 open to the atmosphere.

However, for such a configuration, since suction ports 211*a* and 212*a* are placed above a cap 8, waste liquid 300 in the cap 8 is not emptied. However, even if the cap 8 is decapped (detached) from a recording head 4, such a configuration can maintain waste liquid 300 in the cap 8, thus preventing leaking of the waste liquid 300.

Next, a tenth exemplary embodiment of this disclosure is described with reference to FIGS. 31 and 32.

Figure 31:
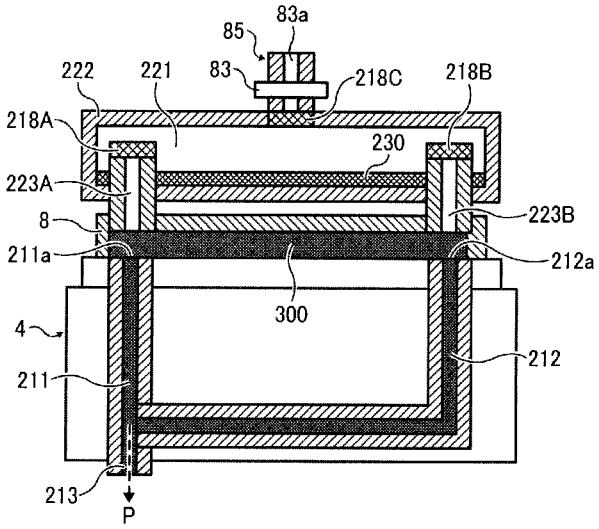
FIG. 31 is a schematic cross-sectional view of a recording head and a cap in an image forming apparatus according to a tenth exemplary embodiment of this disclosure.

FIG. 31 is a schematic cross-sectional view of a recording head and a cap in the tenth exemplary embodiment.

In this tenth exemplary embodiment, the above-described configuration of the seventh exemplary embodiment is applied to an example in which a recording head 4 is arranged so as to eject liquid droplets vertically upward. Passages 223A and 223B are projected to positions higher than the liquid level of liquid 230 in a liquid chamber 221.

Figure 32:
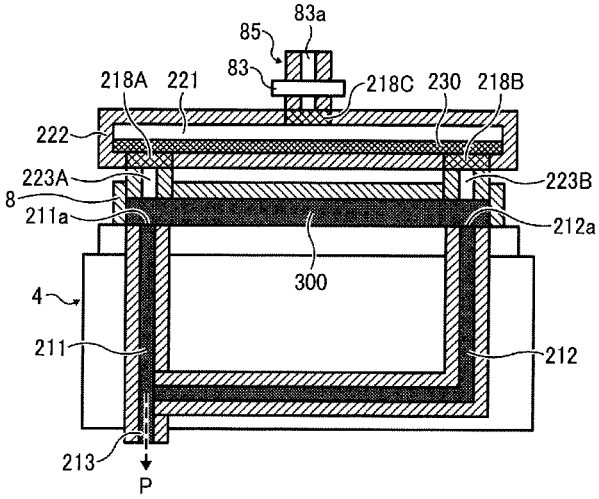
FIG. 32 is a schematic cross-sectional view of a recording head and a cap according to a comparative example in which the configuration of FIG. 27 is applied to a vertically-upward ejection system.

In other words, if the above-described configuration of the seventh exemplary embodiment is applied to an example in which the recording head 4 is arranged so as to eject liquid droplets vertically upward, as illustrated in FIG. 32, liquid 230 is moved to a side of the liquid chamber 221 proximal to separation films 218A and 218B to close the passages 223A and 2238. As a result, even if a suction pump sucks waste liquid 300 with the release valve 83 open, air is not introduced from the passages 223A and 223B into the cap 8.

Hence, as described above, for the tenth exemplary embodiment, the side of each of the passages 223A and 223B proximal to the liquid chamber 221 is placed higher than the liquid level of the liquid 230, thus preventing the passages 223A and 223B from being sealed by the liquid 230.

Next, an eleventh exemplary embodiment of this disclosure is described with reference to FIG. 33.

Figure 33:
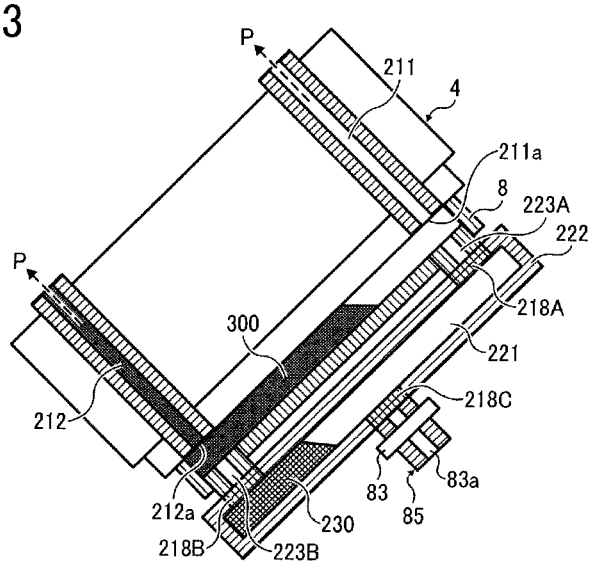
FIG. 33 is a schematic cross-sectional view of a recording head and a cap in an image forming apparatus according to an eleventh exemplary embodiment of this disclosure.

FIG. 33 is a schematic cross-sectional view of a recording head and a cap in the eleventh exemplary embodiment.

For this eleventh exemplary embodiment, suction passages 211 and 212 are connected as separate passages to respective suction pumps in the configuration of the above-described seventh exemplary embodiment.

Such a configuration allows waste liquid 300 to be sucked through one of the suction ports 211*a* and 212*a* placed lower than the other of the suction ports 211*a* and 212*a*.

Next, a twelfth exemplary embodiment of this disclosure is described with reference to FIG. 34.

Figure 34:
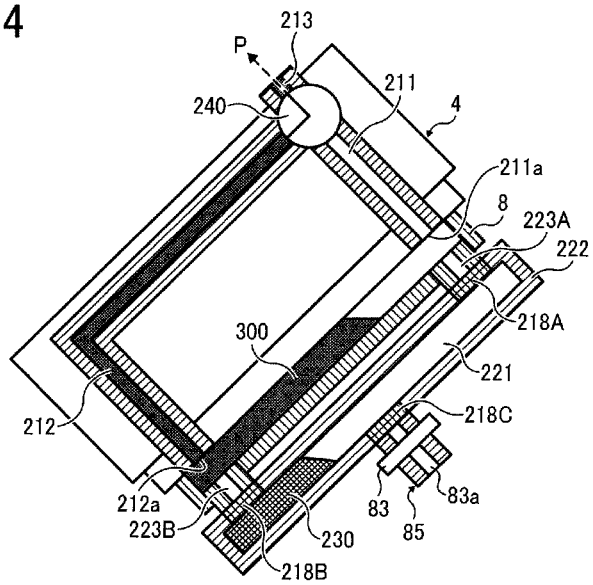
FIG. 34 is a schematic cross-sectional view of a recording head and a cap in an image forming apparatus according to a twelfth exemplary embodiment of this disclosure.

FIG. 34 is a schematic cross-sectional view of a recording head and a cap in the twelfth exemplary embodiment.

For this exemplary embodiment, a switching valve 240 is disposed between a common passage 213 and each of suction passages 211 and 212.

For such a configuration, switching of the switching valve 240 allows waste liquid 300 to be sucked through one of the suction ports 211*a* and 212*a* placed lower than the other of the suction ports 211*a* and 212*a*.

Next, a thirteenth exemplary embodiment of this disclosure is described with reference to FIGS. 35 and 36.

Figure 35:
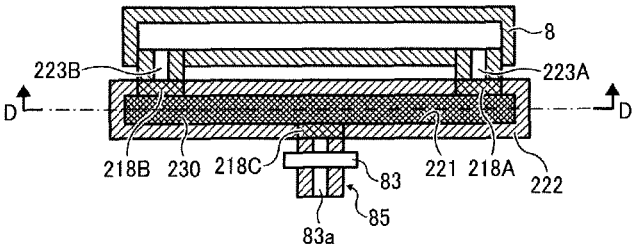
FIG. 35 is a schematic cross-sectional view of a cap and a liquid chamber in an image forming apparatus according to a thirteenth exemplary embodiment of this disclosure.
Figure 36:
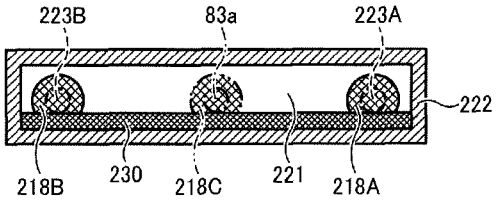
FIG. 36 is a cross-sectional view of the liquid chamber cut along a line D-D of FIG. 35.

FIG. 35 is a schematic cross-sectional view of a cap and a liquid chamber in the thirteenth exemplary embodiment. FIG. 36 is a cross-sectional view of the liquid chamber cut along a line D-D of FIG. 35.

For this exemplary embodiment, a recording head 4 is displaceable between a position at which the recording head 4 ejects vertically upward and a position at which the recording head 4 ejects obliquely downward or horizontally. In FIGS. 35 and 36, a cap 8 and a liquid chamber member 222 are placed at positions at which the recording head 4 ejects liquid droplets vertically upward.

The liquid chamber member 222 is placed opposing a side face of the cap 8. A release port 83*a* and passages 223A and 223B are disposed at positions higher than the liquid level of liquid 230.

For such a configuration, with the recording head 4 placed so as to eject liquid droplets vertically upward (a nozzle face of the recording head 4 faced up), the release port 83*a* and the passages 223A and 223B are not sealed by the liquid 230. When the recording head 4 is tilted (or leveled) from such a state, a lower one of the passages 223A and 223B is sealed by the liquid 230, thus allowing execution of maintenance and recovery operation while preventing bubbles from adhering on the nozzle face.

By contrast, if the passages 223A and 223B of the liquid chamber member 222 are sealed by the liquid 230, air would not be introduced into the cap 8. In such a case, waste liquid 300 might not be removed from the cap 8 before decapping, thus causing leak of the waste liquid 300.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an apparatus body usable in any of a vertical or horizontal arrangement;

a recording head having a nozzle face with nozzles to eject liquid droplets, the recording head placed in the apparatus body so as to eject the liquid droplets obliquely downward in any of the vertical or horizontal arrangement of the apparatus body;

a cap to contact and cap the nozzle face of the recording head and having openings at opposed ends in a longitudinal direction of the cap to communicate an inside of the cap with an outside of the cap;

a suction device connected to the cap, the cap including a suction port provided between the openings and connected to the suction device in a longitudinal direction of the cap; and plural release valves provided to the respective openings to open and close the openings relative to an ambient atmosphere, the release valves being not connected to the suction device, wherein one of the release valves placed higher than another one of the release valves in accordance with the vertical or horizontal arrangement of the apparatus body is configured to open the inside of the cap to the ambient atmosphere through one of the openings placed higher than another one of the openings.

2. The image forming apparatus of claim 1, wherein the cap comprises a cap body to receive waste liquid discharged from the recording head, the cap body has a triangular shape with a first edge, a second edge, and a base edge in a cross section, the cap body has the base edge at a first side at which the cap is configured to oppose the recording head and an apex formed by the first edge and the second edge at a second side opposite to the first side, and the cap body has, at the apex, a suction port connected to the suction device.

3. The image forming apparatus of claim 2, wherein a first angle formed by the nozzle face of the recording head and a plane on which the apparatus body is placed is smaller than a second angle formed by the base edge of the cap body and one of the first edge or the second edge placed lower than the other of the first edge or the second edge.

4. The image forming apparatus of claim 1, wherein an opening direction of the openings is perpendicular to an opening direction of the suction port.

5. An image forming apparatus, comprising:

an apparatus body usable in any of a vertical or horizontal arrangement;

a recording head having a nozzle face with nozzles to eject liquid droplets, the recording head placed in the apparatus body so as to eject the liquid droplets obliquely downward in any of the vertical or horizontal arrangement of the apparatus body;

a cap to contact and cap the nozzle face of the recording head and having openings at opposed ends in a longitudinal direction of the cap to communicate an inside of the cap with an outside of the cap;

a suction device connected to the cap, the cap including a suction port provided between the openings and connected to the suction device in a longitudinal direction of the cap; and plural release valves provided to the respective openings to open and close the openings relative to an ambient atmosphere, the release valves being not connected to the suction device, wherein the cap comprises a cap body to receive waste liquid discharged from the recording head, the cap body has a triangular shape with a first edge, a second edge, and a base edge in a cross section, the cap body has the base edge at a first side at which the cap is configured to oppose the recording head and an apex formed by the first edge and the second edge at a second side opposite to the first side, the cap body has, at the apex, a suction port connected to the suction device, and a first angle formed by the nozzle face of the recording head and a plane on which the apparatus body is placed is smaller than a second angle formed by the base edge of the cap body and one of the first edge or the second edge placed lower than the other of the first edge or the second edge.

* * * * *